US005660382A

United States Patent [19]

Meier

[11] Patent Number: 5,660,382

[45] Date of Patent: Aug. 26, 1997

[54] FLEXIBLE CONVEYING SYSTEM

[75] Inventor: Jacques Meier, Bäretswil, Switzerland

[73] Assignee: Ferag AG, Hinwil, Switzerland

[21] Appl. No.: 512,702

[22] Filed: Aug. 8, 1995

[30] Foreign Application Priority Data

Aug. 11, 1994 [CH] Switzerland ..... 02485/94

[51] Int. Cl.[6] ..... B65H 39/00

[52] U.S. Cl. ..... 270/52.16; 270/52.29; 270/58.29; 198/464.2; 271/206

[58] Field of Search ..... 271/69, 82, 206, 271/306; 198/464.2, 810.01; 270/52.16, 52.26, 52.29, 58.23, 58.29

[56] References Cited

U.S. PATENT DOCUMENTS

| | | | |
|---|---|---|---|
| 3,032,341 | 5/1962 | Reist | 271/206 X |
| 4,018,327 | 4/1977 | Goodman et al. | 198/464.2 X |
| 4,039,182 | 8/1977 | Reist et al. . | |
| 4,197,935 | 4/1980 | Aterianus et al. | 198/464.2 X |
| 4,201,286 | 5/1980 | Meier | 271/206 X |
| 4,718,656 | 1/1988 | Reist | 271/69 X |
| 4,887,809 | 12/1989 | Eberle | 271/206 X |
| 4,893,805 | 1/1990 | Eberle | 271/82 X |
| 4,953,843 | 9/1990 | Reist | 271/306 X |
| 5,280,895 | 1/1994 | Meier | 270/58.29 X |
| 5,324,025 | 6/1994 | Chadwick et al. | 271/306 X |

FOREIGN PATENT DOCUMENTS 667 860 11/1988 Switzerland .

*Primary Examiner*—Hoang Nguyen

*Attorney, Agent, or Firm*—Bell, Seltzer, Park & Gibson, P.A.

[57] ABSTRACT

Process for operating a piece-goods transporting apparatus such as printed products wherein the products which are fed individually one after the other are received at a receiving position by transporting members circulating in a continuously guide of the transporting apparatus. They are then conveyed via a buffer section to a discharge position. In this arrangement, the transporting members are each retained at the receiving position until a product has been received, thereby ensuring that each transporting member leaves the receiving position with a received product. The transporting members run through the discharge position periodically in cycles and discharge a product to the processing section in each cycle.

17 Claims, 6 Drawing Sheets

FLEXIBLE CONVEYING SYSTEM

FIELD OF THE INVENTION

The invention relates to a process for operating a piece-goods transporting apparatus, in particular for printed products.

BACKGROUND OF THE INVENTION

The process includes receiving individual products sequentially at a receiving position on transporting members continuously circulating wherein the products are conveyed by a buffer section to a discharge position. The transporting members are retained at the receiving position until a product has been received, thereby ensuring that each transporting member leaves the receiving position with a received product.

Processes of this type are necessary, for example, when forming multiple component printed products. In this arrangement, different individual or part-products are transferred in parallel operation by one feed conveyor to an apparatus for compiling the printed products to form final products comprising the individual or part-products.

In this arrangement, the apparatus for compiling the printed products comprises a plurality of receiving means which are driven in circulation to sequentially move past the various feed conveyors where they are each provided with individual or part-products. In this manner, a final product comprising a plurality of individual or part-products is formed in each receiving means or on each rest.

In the case of the process described, the situation may occur where the individual or part-products are not fed from the feed conveyors in an absolutely regular and continuous manner. In particular it is possible that, in the case of a feed conveyor configured as a clamp-type transporter, individual clamps do not, as a result of a brief malfunction, bear any individual or any part-product.

Ultimately, this leads to the situation where the individual or part-product to be fed by the relevant feed conveyor is missing in one of the final products. This problem exists in prior art processes.

To prevent this, known processes provide a buffer section positioned between the feed conveyors and the apparatus for forming the products. At the buffer section, the individual or part-products fed by the respective feed conveyor are temporarily retained until being discharged. The products are thus controlled such that incomplete final products are guided past all the buffer sections once again and individual or part-product are discharged only at that buffer section at which discharge did not take place during the first run, as a result of which, completion of the final product which was not yet complete after the first run is achieved.

An object of the invention consists of improving the above-mentioned processes and ensuring, in particular with the lowest possible degree of outlay and the greatest possible degree of certainty, that only complete final products are produced.

SUMMARY OF THE INVENTION

This object is achieved according to the invention in that the transporting members run through the discharge position periodically in cycles and discharge a product in each cycle.

In accordance with the present invention, the individual or part-products are provided by a feed conveyor and are received in a region of the buffer section by transporting members to ensure that each transporting member retains an individual or part-product and can then discharge the same. A received individual or part-product is conveyed by means of each transporting member which moves along the buffer section from the receiving position to the discharge position. Since each transporting member is arrested at the receiving position until an individual or part-product has been received, it is ensured that empty transporting members do not run through the buffer section from the receiving position to the discharge position.

Retaining the transporting members at the receiving position is also intended to ensure that the transporting members are moved in a precisely defined manner at a defined speed to receive a product.

According to the present invention, each transporting member arriving at the discharge position bears an individual or part-product and as a result the transporting members can run through the discharge position periodically in cycles and discharge a product in each cycle. Special control of the transporting members at the discharge position wherein the discharge of individual or part-products can be slowed down or interrupted is no longer necessary according to the present invention.

In contrast to known processes, the present invention does not require incomplete final products to be once again run through the processing section in which the final products are brought together with the missing individual or part-products being added. Rather, it is ensured that at the discharge positions arranged respectively at the end of the buffer sections, each incoming transporting member bears an individual or part-product and the discharge of an individual or part-product takes place in each cycle. Consequently, a continuous, periodic discharge of individual or part-products is possible, thereby ensuring that only complete final products are produced. It is also possible that final products may be produced by a single run through the processing section, wherein the second completion run can be dispensed with.

Omitting the second completion run achieves a considerable time saving with respect to known processes and, on the other hand, makes it possible for the process according to the invention to be carried out in a considerably more cost-effective manner, since complicated activation of the transporting members circulating along the buffer section in the region of the discharge position can be fully dispensed with.

The process according to the invention is preferably used on apparatuses wherein individual or part-products which are to compiled are fed to a processing section by a plurality of feed conveyors operated in parallel.

In this arrangement, a single feed conveyor may be utilized and various individual or part-products can be transported past the receiving positions of the transporting apparatuses according to the invention. The transporting apparatus can thus be operated so that only every nth product is received at the receiving position of the transporting apparatus.

According to another embodiment of the present process, two transporting apparatuses operating according to the invention are arranged in parallel between a feed conveyor and a processing section. The feed conveyor then delivers two different products alternately, and the transporting members of the first transporting apparatus receives every second product and the transporting members of the second transporting apparatus receives the products not received by the transporting members of the first transporting apparatus. This results in a division of the mixed product stream delivered by the feed conveyor into two separate product streams which run over the respective transporting apparatus and each comprise identical products. The first transporting apparatus comprises a processing section which is exclusively fed with products of a first type, and the second transporting apparatus is exclusively fed with products of a second type. All the product-receiving means arranged on the processing section can thus each be provided in a simple manner with a product of the first type and a product of the second type. The precondition for this is that the transporting speed of the product-receiving means of the processing section is approximately half the transporting speed of the feed conveyor.

Division of a mixed product stream onto different processing sections can also be achieved by means of the above-described preferred process.

According to another embodiment of the present invention, instead of only two transporting apparatuses arranged in parallel, it is also possible for a plurality of such units to be arranged one behind the other, as a result of which division of a mixed fed product stream into a corresponding number of individual-product streams each exhibiting identical products can be achieved.

The above-mentioned preferred process in which only every nth product is received is once again described in detail in the following description of the figures.

BRIEF DESCRIPTION OF THE DRAWINGS

The invention is explained hereinbelow, by way of examples, with reference to the drawing, in which.

DETAILED DESCRIPTION OF THE INVENTION

Figure 1:
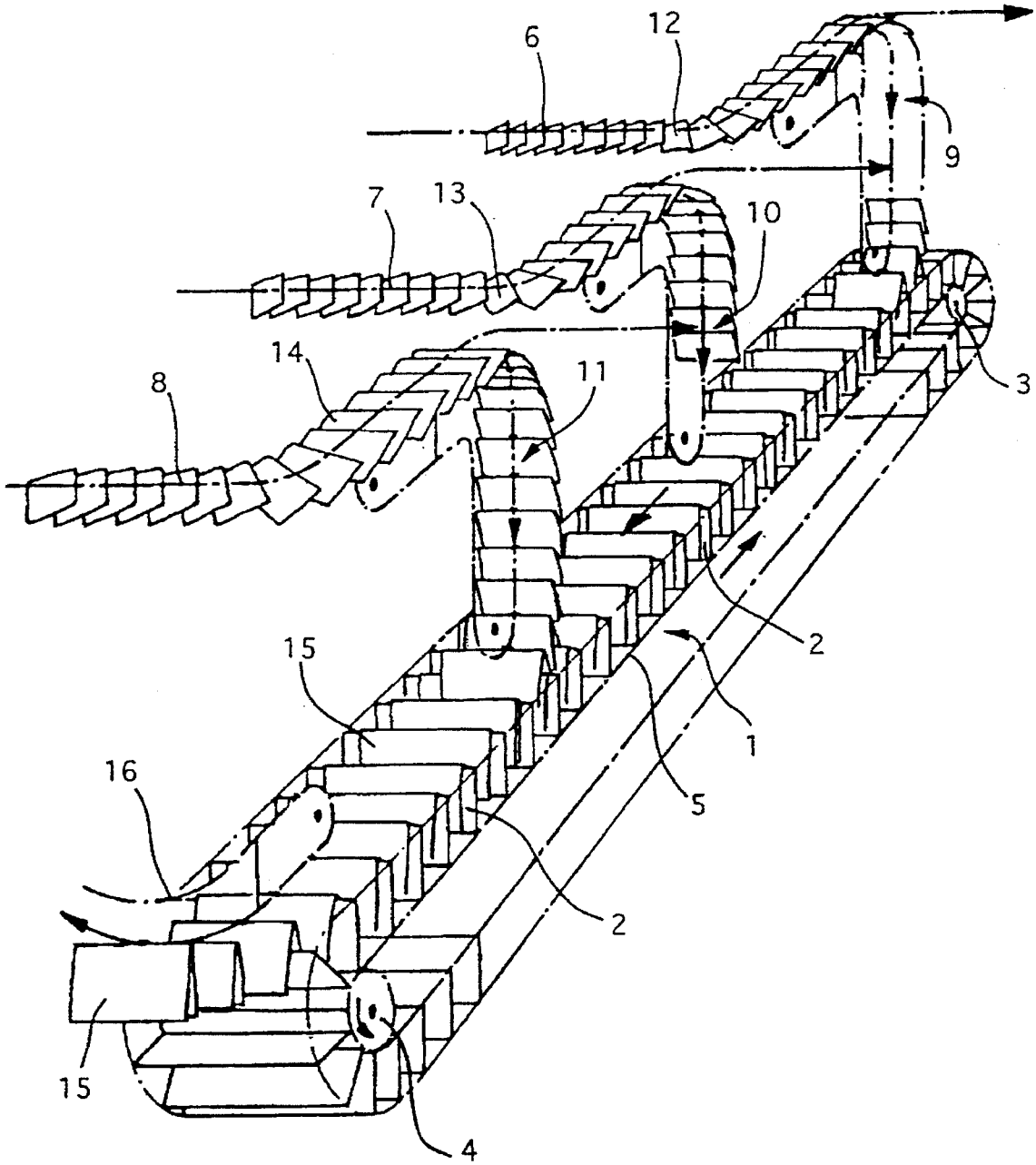
FIG. 1 is a top perspective view of the apparatus operating according to the present invention.

FIG. 1 shows a processing section 1 which is designed as a circulation system and has saddle-like rests 2 which are driven in circulation, spaced apart from one another at regular intervals and are in connection with a belt 5 driven around two rollers 3, 4. The drive direction of the roller 4 is illustrated by the arrow. The rests 2 may also be arranged on chains guided around chain wheels.

Three separate feed conveyors 6, 7, and 8 are arranged along the upper strand of the processing section 1, wherein each of the transporting apparatuses 9, 10, and 11 operating according to the present invention are arranged between the feed conveyors 6, 7, and 8 and the upper strand of the processing section 1.

Arranged at the end of the upper strand of the processing section 1 is a removal conveyor 16 which is suitable for removing the final products from the processing section 1 and guiding them away.

The apparatus represented operates as follows: Individual or part-products 12, 13, and 14 are transferred in parallel operation, by the feed conveyors 6, 7, and 8 to the transporting apparatuses 9, 10, and 11 which likewise function in parallel operation.

The piece-goods transporting apparatuses 9, 10, and 11 exhibit a number of circulating transporting members which are suitable for receiving the fed individual or part-products and discharging them again.

In the region of the receiving positions of the transporting apparatuses 9, 10, and 11, i.e., in the region in which the feed conveyors 6, 7, and 8 interact with the piece-goods transporting apparatuses 9, 10, and 11, the transporting members are each arrested until such time as the respectively next individual or part-product 12, 13, or 14 is provided and received by the respective transporting member. This ensures that no transporting member of the piece-goods transporting apparatuses 9, 10, or 11 leaves the respective receiving position without a received individual or part-product.

The transporting members provided with individual or part-products 12, 13, or 14 then pass a buffer section which is arranged between the receiving position and the discharge position and in which the transporting members which have been provided with products are temporarily stored. In order to temporarily store the products, the transporting members of the piece-goods transporting apparatuses 9, 10, and 11 are guided in the region of the buffer section such that the distance between two successive transporting members in each case is variable.

In the region of the discharge positions of the piece-goods transporting apparatuses 9, 10, and 11, i.e., in that region in which the piece-goods transporting apparatuses 9, 10, or 11 interact with the upper strand of the processing section 1, the individual or part-products 12, 13, or 14 are discharged periodically in cycles, thereby ensuring that each rest 2 which passes a discharge position is provided with an individual or part-product. This mode of operation precludes the situation where a rest 2 is conveyed past a discharge position of a piece-goods transporting apparatus 9, 10, or 11 in a defective manner without an individual or part-product 12, 13, or 14 being deposited.

Since the individual piece-goods transporting apparatuses 9, 10, and 11 are arranged one after the other along the processing section 1, the individual rests 2 pass the discharge positions of the piece-goods transporting apparatuses 9, 10, or 11 sequentially. Thus, individual or part-products 12, 13, or 14 are deposited one on top of the other on a rest 2 and can thus be brought together to form a final product After the last individual or part-product has been deposited on the respective rest 2 by the piece-goods transporting apparatus 11, the rest 2 bearing the final product 15 passes into the region of the removal conveyor 16, which raises the final product 15 from the respective rest 2 and conveys it away from the processing section 1 in the arrow direction.

According to the above process, the cycle in which the individual or part-products 12, 13, or 14 are deposited at the discharge positions on the rests 2 of the processing section 1 is synchronized with the transporting speed of the rests 2 along the processing section 1. During each cycle, one rest 2 is conveyed past each discharge position of the piece-goods transporting apparatuses 9, 10, and 11. The operating cycle set at the discharge positions of the piece-goods transporting apparatuses 9, 10, and 11 is the same for all the piece-goods transporting apparatuses.

The buffer section permitting temporary storage of individual or part-products 12, 13, or 14 permits the feed conveyors 6, 7, and 8 to operate in a cycle which deviates from the cycle set at the discharge positions or from the phase position thereof, since such deviations can be compensated for by the temporarily stored individual or part-products 12, 13, or 14. Precise cycle and phase synchronization can thus be avoided. The current receiving capacity of the piece-goods transporting apparatuses 9, 10, and 11 can thus differ from the discharge capacity. In particular, the process described can also compensate for any product gaps occurring in the region of the feed conveyors 6, 7, and 8, i.e., despite a briefly interrupted feed of individual or part-products 12, 13, or 14 from the feed conveyors 6, 7, and 8 to the piece-goods transporting apparatuses 9, 12, and 11 a continuous discharge of individual or part-products 12, 13, or 14 at the discharge positions of the piece-goods transporting apparatuses 9, 10, and 11 can be ensured.

The processing section 1 represented in FIG. 1 is designed such that the individual or part-products 12, 13, or 14 are collected on the saddle-like rests 2. Use may likewise be made of a processing section in which the products are brought together by means of collecting, collating and/or inserting. It is also possible to use a drum system instead of the circulation system represented in FIG. 1.

Figure 2:
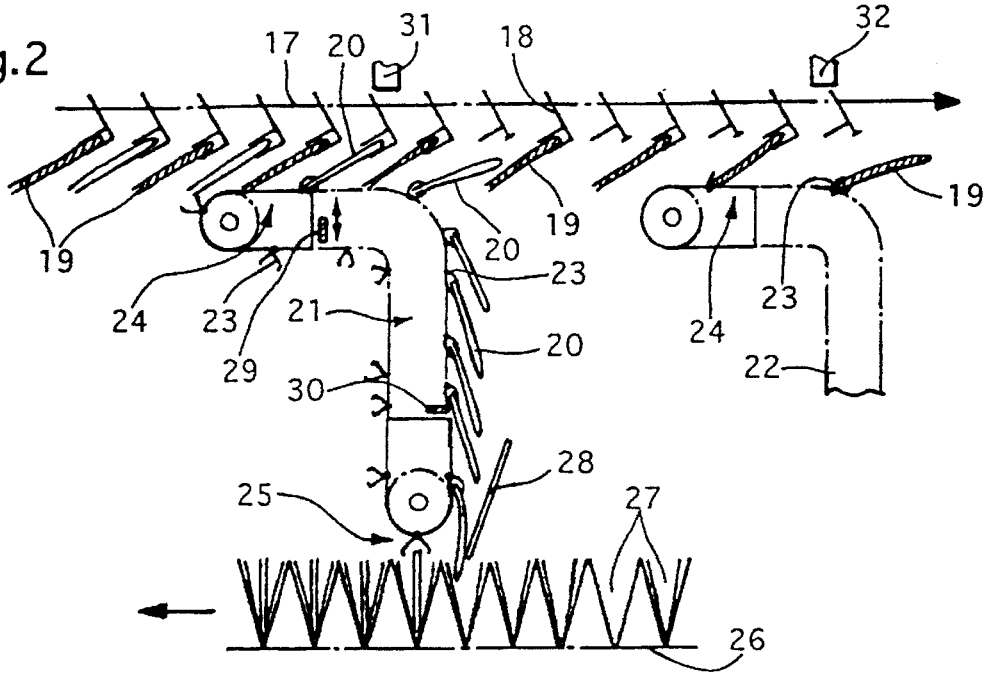
FIG. 2 is a schematic view of a first embodiment of the transporting apparatus operating according to the present invention and is arranged between a feed conveyor and a removal conveyor.

FIG. 2 shows a feed conveyor 17 which is designed as a clamp-type transporter and has grippers 18 which are spaced apart from one another at regular intervals, conveyed in the arrow direction and are suitable for receiving an individual or part-product 19, 20.

Arranged along the feed conveyor 17 are two piece-goods transporting apparatuses 21, 22 which operate according to the invention and each comprise grippers 23 which are circularly driven wherein products 19, 20 can be received in the region of the receiving positions 24 and can be discharged in the region of the discharge positions 25. Arranged in the region of the discharge positions 25 is an apparatus which is intended for bringing together printed products 26 and comprises a series of sequentially arranged receiving means 27 which are transported past the discharge positions 25 in the arrow direction. In this arrangement, the receiving means 27 are suitable for compiling printed products.

Directing plates 28 are arranged in the region of the discharge positions 25 to ensure that the products 19, 20 transported to the discharge positions 25 are deposited on, or inserted in, the receiving means 27 in a guided manner.

Provided in the region of the receiving positions 24 is a blocking element 29 which can be moved in the direction of the depicted double arrow and is acted upon, and can be actuated, by an intelligent control unit (not shown). For reasons of clarity, the blocking element 29 of the piece-goods transporting apparatus 22 is not depicted.

The blocking element 29 is activated in such a manner that, while two products 19, 20 run past the receiving position 24, one gripper 23 passes the blocking element 29. Consequently, per unit of time, there are half as many grippers 23 at the receiving position 24 which are ready for receiving purposes as there are products 19, 20 conveyed into the region of the receiving position 24, this resulting in only every second product 20 being received by the grippers 23 of the piece-goods transporting apparatus 21.

Consequently, the other products 19 are conveyed past the piece-goods transporting apparatus 21 in the direction of the piece-goods transporting apparatus 22. The blocking element provided in the piece-goods transporting apparatus 22 is timed in accordance with the blocking element 29 of the piece-goods transporting apparatus 21, with the result that all the products 19 arriving at the receiving position 24 of the piece-goods transporting apparatus 22 are received by successive grippers 23 of the piece-goods transporting apparatus 22.

For the instance where two products 19, 20 following one after the other in the region of the feed conveyor 17 differ from one another, the process described can carry out a division of the products into two separate product streams running via in each case one piece-goods transporting apparatus 21, 22, the two product Streams comprising only identical products 19, 20. In this arrangement, the products 20 are conveyed by the piece-goods transporting apparatus 21 and the products 19 are conveyed by the piece-goods transporting apparatus 22.

Provided in the region of the discharge positions 25 of the piece-goods transporting apparatuses 21, 22 is a further blocking element 30 which is moved periodically in a cycle in an uncontrolled manner and thus makes it possible for one gripper 23 provided with a product 19, 20 to pass during each cycle. Control of the blocking element 30 is unnecessary since, due to the controlled receiving of products, it is ensured that each gripper 23 which passes into the region of the blocking element 30 is provided with a product 19, 20.

The transporting speed of the receiving means 27 is synchronized with the cycle of the blocking elements 30 arranged in the region of the discharge positions 25 ensures that only one receiving means 27 is conveyed past the respective discharge position 25 per cycle.

Since only every second product 19, 20 is removed from the feed conveyor 17 by each piece-goods transporting apparatus 21, 22 and each receiving means 27 is provided with a product by the two piece-goods transporting apparatuses 21, 22, the transporting capacity of the feed conveyor 17 is approximately double the transporting capacity of the receiving means 27.

In order to permit a problem-free transfer of products 19, 20 from the feed conveyor 17 to the piece-goods transporting apparatuses 21, 22, provision is made, in the region in which the feed conveyor 17 interacts with the piece-goods transporting apparatuses 21, 22, for actuating elements 31, 32 which control the opening of the grippers 18. Opening of the grippers 18 is initiated whenever a product 19, 20 retained by a gripper 18 is seized by a gripper 23 of the piece-goods transporting apparatuses 21, 22. In the case of the process shown in FIG. 2, only every second gripper 18 which runs past an actuating element 31, 32 is opened. It is also conceivable, instead of in the "split process", to feed the transporting apparatuses 21, 22 with the products in sections, i.e. a plurality of products one after the other in each case.

It is possible to modify an apparatus shown in FIG. 2 such that, instead of two piece-goods transporting apparatuses, n (where n>2) piece-goods transporting apparatuses are arranged along an individual feed conveyor. In this case, every piece-goods transporting apparatus then removes, for example, only every nth product delivered by the feed conveyor. Accordingly, the product stream delivered by the feed conveyor is divided into n parallel product streams.

It is within the scope of the present invention that any number of methods of activation may be utilized wherein a setting can freely be made to determine how many products pass the receiving position of a piece-goods transporting apparatus between two received products without being received themselves.

The piece-goods transporting apparatuses 21, 22 are configured at an angle, with the result that the received products are initially conveyed over part of the way in the horizontal direction and are then conveyed vertically in a direction toward the receiving means 27.

Figure 3:
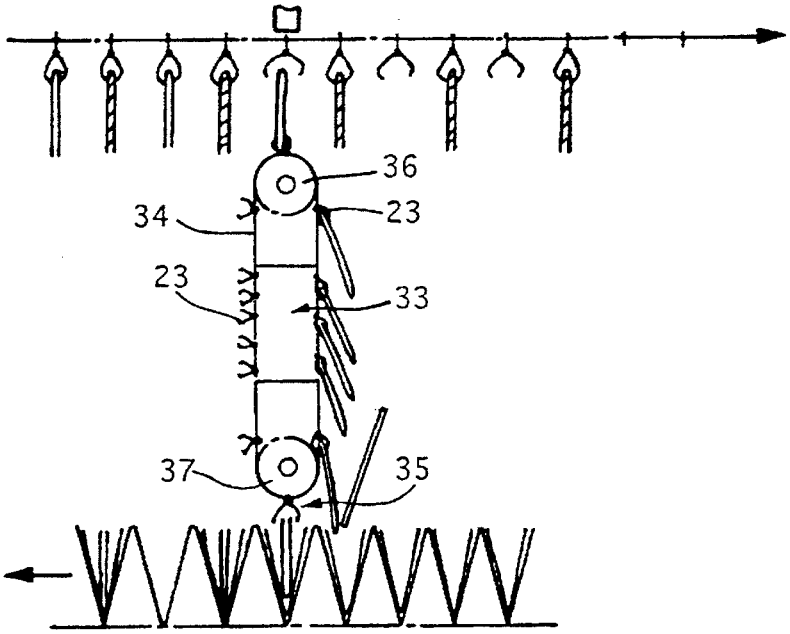
FIG. 3 is a schematic view of a second embodiment of a transporting apparatus operating according to the present invention which is arranged between a feed conveyor and a removal conveyor.

FIG. 3 shows an apparatus corresponding essentially to FIG. 2, but wherein for clarity the second piece-goods transporting apparatus is not depicted.

FIG. 3 differs from FIG. 2 in that the piece-goods transporting apparatus 33 is not designed at an angle, but extends essentially in the vertical direction, grippers 23 being fastened on a transporting means 34 which is driven in circulation around two rollers 36, 37.

That region of the piece-goods transporting apparatus 33 which is located between the two rollers 36, 37 and in which the received products are stored temporarily is designed as a buffer section, in the same way as for the transporting apparatuses 21, 22 according to FIG. 2, the distance of the individual grippers 23 from one another being variable in order to permit storage of a variable number of grippers 23 provided with products. In the region of the discharge position 35 of the piece-goods transporting apparatus 33, the grippers 23 are each spaced apart at the same distance from one another, in the same way as for the piece-goods transporting apparatuses according to FIG. 2.

The piece-goods transporting apparatuses operating according to the invention can be designed in accordance with the European Patent Application No. 0511 159 A1, the European Patent 0 309 702 B1, the Swiss Patent Application 02040/93-6 which corresponds to U.S. Pat. No. 5,503,264, or the Swiss Patent 618398.

Figure 4:
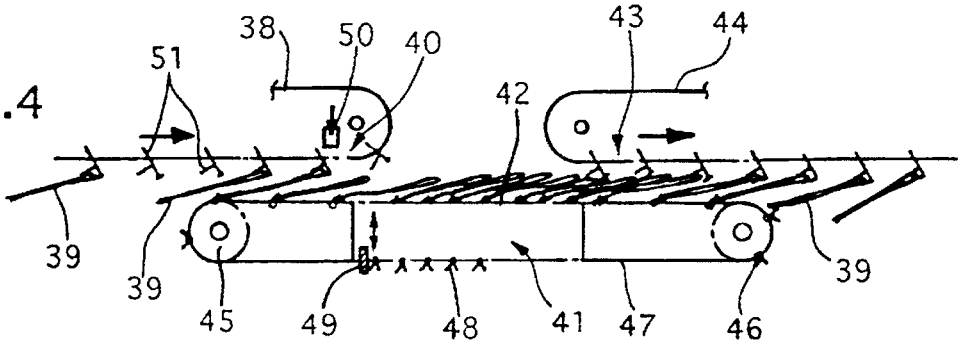
FIG. 4 is a schematic view of a third embodiment of a transporting apparatus operating according to the present invention which is arranged between a feed conveyor and a removal conveyor.

FIG. 4 shows a feed conveyor 38 which is designed as a clamp-type transporter and conveys products 39 approximately horizontally in the direction of the receiving position 40 of a piece-goods transporting apparatus 41, at which the products 39 are transferred from the feed conveyor 38 to the piece-goods transporting apparatus 41.

The receiving position 40 of the essentially horizontally conveying piece-goods transporting apparatus 41 is adjoined in the conveying direction by a buffer section 42, at the end of which the discharge position 43 of the piece-goods transporting apparatus 41 is located.

At said discharge position 43, the piece-goods transporting apparatus 41 is coupled to a removal conveyor 44 which is likewise designed as a clamp-type transporter and receives the products 39 from the piece-goods transporting apparatus 41.

The piece-goods transporting apparatus 41 essentially comprises a conveying means 47 which circulates around two rollers 45, 46 and on which grippers 48 are guided. In the region of the buffer section 42, the distance of adjacent grippers 48 from one another is variable in order to permit the temporary storage of a different number of grippers 48 provided with products 39.

Provided upstream of the receiving position 40 in the conveying direction is a blocking element 49 which arrests the grippers 48 and can be actuated or activated in accordance with the blocking element 29 according to FIG. 2.

In that region of the feed conveyor 38 in which the products 39 are transferred to the piece-goods transporting apparatus 41, there is arranged an actuating element 50 which operates in accordance with the actuating elements 31, 32 according to FIG. 2 and ensures problem-free transfer of the products 39 from the feed conveyor 38 to the piece-goods transporting apparatus 41 by accurately timed opening of the grippers of the feed conveyor The product stream fed by means of the feed conveyor 38 exhibits a double gap 51, wherein two grippers are moved in the direction of the receiving position 40 which do not bear a product 39. This double gap is detected by a detection unit (not shown), whereupon the blocking element 49 is activated in such a manner that the gripper 48 is arrested until such time as the next product 39 following the double gap 51 passes into the region of the receiving position 40. This precludes the situation where a gripper 48 of the piece-goods transporting apparatus 41 passes into the region of the receiving position 40 without it being able to receive a product 39 there. The blocking element 49 has the effect of the next gripper 48 being able to pass into the region of the receiving position 40 only when a product 39 is delivered by the feed conveyor 38 once again. It is thus ensured that, in the region of the buffer section 42, each of the grippers 48 is provided with a product 39. In the same manner, receiving of a fed defective product can be prevented; this is regarded as an "artificial gap".

The product stream in the feed conveyor 38 and in the removal conveyor 44, it is apparent that gaps occurring in the product stream can be closed by the piece-goods transporting apparatus 41 which operates according to the invention and is arranged between the feed conveyor and the removal conveyor, with the result that the removal conveyor 44 conveys a continuous, gap-free product stream. The distances between the grippers in the feed conveyor and removal conveyor 38, 44 may thus also be selected to be different.

Figure 5A:
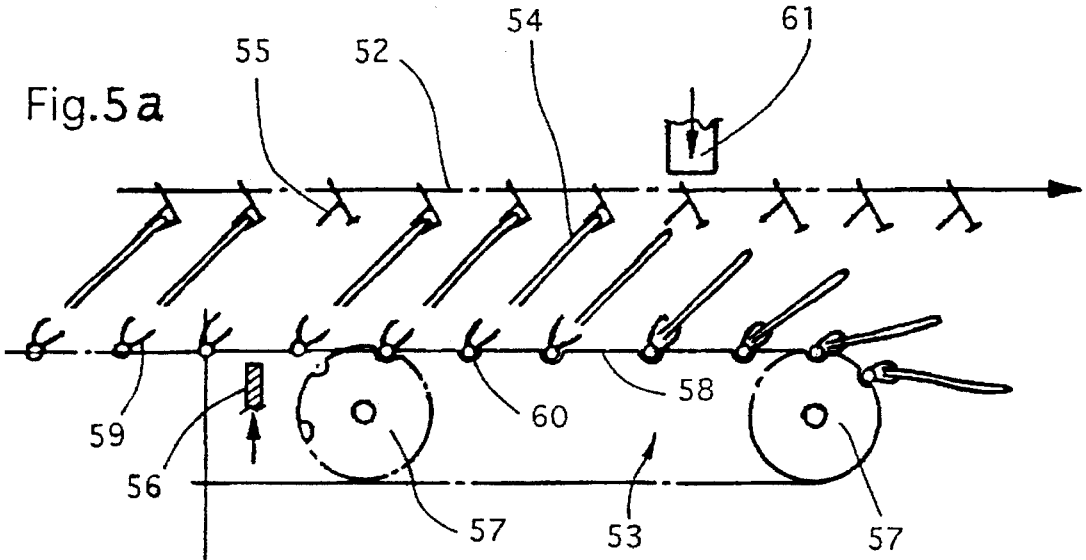
FIGS. 5*a*–5*c* are schematic views of different operating phases of a transporting apparatus, operating according to the invention shown in the region of the receiving position.
Figure 5B:
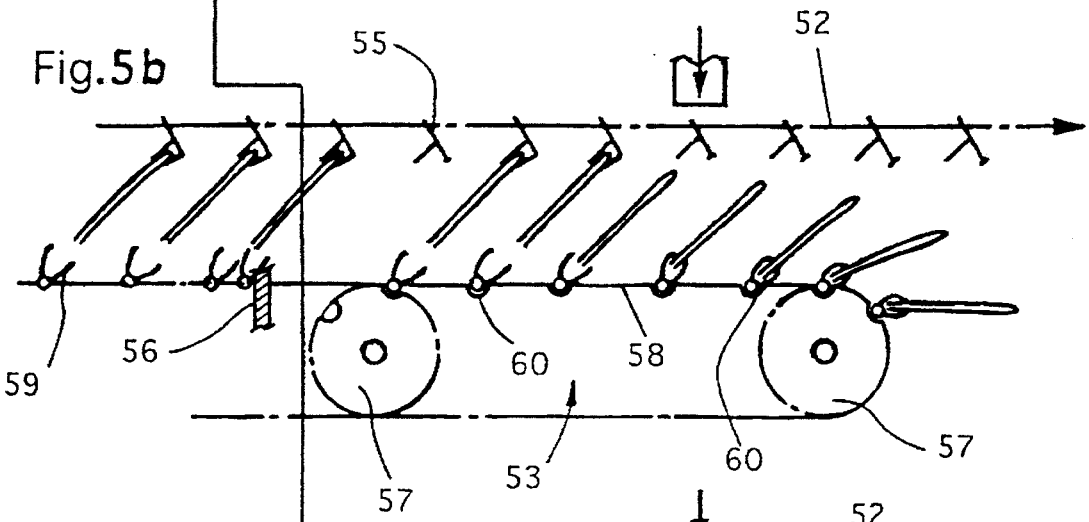
Figure 5C:
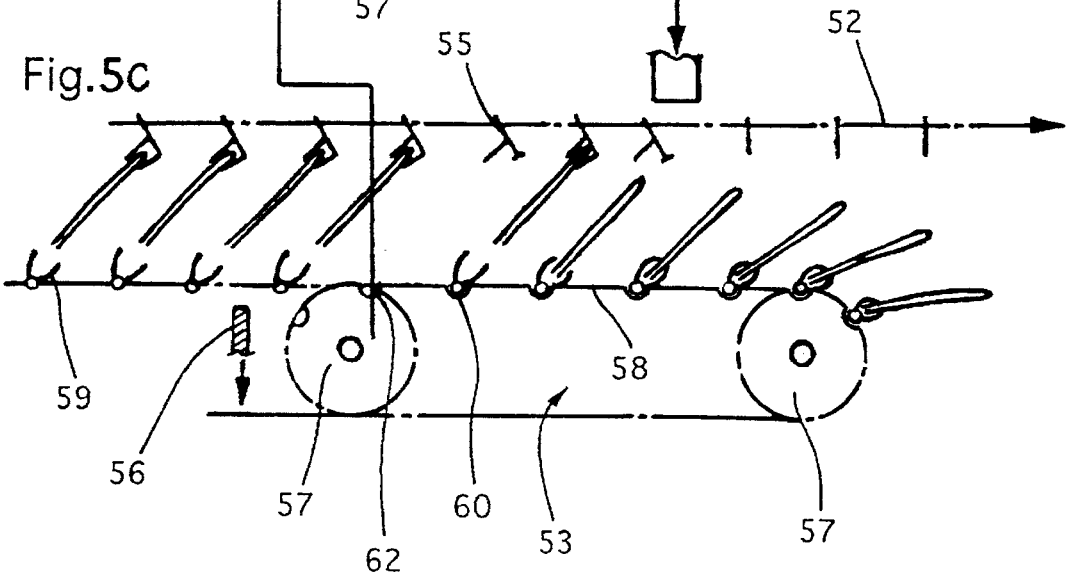

FIGS. 5*a* to *c* show various operating states of a piece-goods transporting apparatus 53 interacting according to the invention with a feed conveyor 52, as is disclosed in Swiss Patent Application 0 2040/93-6 and corresponding U.S. Pat. No. 5,503,264.

Products 54 are conveyed in the arrow direction by means of the feed conveyor 52, the product stream provided by the feed conveyor 52 comprising a gap at 55.

The piece-goods transporting apparatus 53 comprises a driver member 58 which circulates around two rollers 57 and to which the grippers 59 can be coupled. In that region of the conveying section of the piece-goods transporting apparatus 53 which follows the driver member 58, the grippers 59 can be displaced with respect to one another in order to form a buffer section. In a region provided upstream of the driver member 58, the grippers 59 can also be displaced with respect to one another in order to form a buffer for the grippers 59.

In the region of the driver member 58, the grippers 59 are guided in guides 60 of the driver member 58, and the grippers 59 are spaced apart at the same distance from one another.

Provided upstream of the rollers 57 in the conveying direction is a controllable blocking element 56 which can be actuated analogously to the blocking elements 29 according to FIG. 2.

Provided at that position where the products 54 are transferred from the feed conveyor 52 to the piece-goods transporting apparatus 53 is an actuating element 61 and the transporting members or the grippers of the feed conveyor 52 can be opened.

In the operating state represented in FIG. 5*a*, the gap 55 is detected by means of a detection unit (not shown), which results in an upward movement of the blocking element 56 in the arrow direction.

Consequently, the blocking element is, finally, moved into the position which is shown in FIG. 5*b* and in which the grippers 59 moved in the conveying direction of the piece-goods transporting apparatus 53 are arrested before they pass into that region of the piece-goods transporting apparatus 53 in which they receive products from the feed conveyor 52. In order to permit such an arresting operation, the grippers 59 upstream of the blocking element 56, as seen in the transporting direction, can be displaced relative to one another in the transporting direction, with the result that the grippers 59 upstream of the blocking element 56 (as is represented in FIG. 5*b*) may be spaced apart at a different distance from one another.

The arresting, effected by the blocking element 56, of a gripper 59 results in a guide 60 passing into the region located between the two rollers 57 without a gripper 59 being conveyed. This thus creates a gap 62, moved synchronously with the gap 55 of the feed conveyor 52, with respect to the grippers 59 of the piece-goods transporting apparatus 53. This thus prevents the situation where a gripper 59 passes into the region located between the two rollers 57 without a product 54 being received from the feed conveyor 52.

After a gripper 59 has been arrested by means of the blocking element 56 and after the associated creation of the gap 62, the blocking element 56 is moved downwards according to the arrow represented in FIG. 5*c*, whereupon the grippers 59 can pass once again in an unobstructed manner into the region which is located between the two rollers 57 and in which the products 54 are received from the feed conveyor 52.

Figure 6:
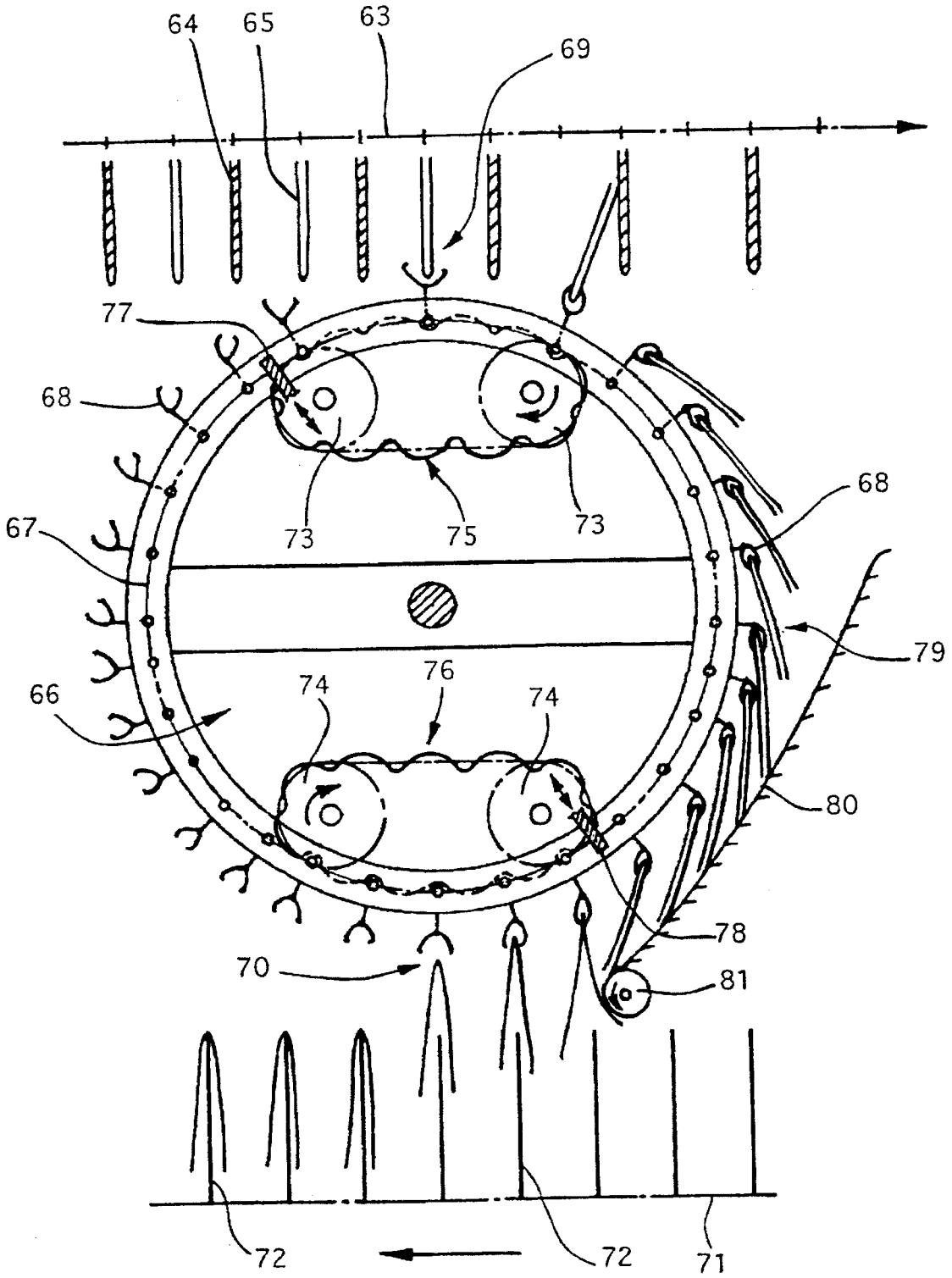
FIG. 6 is a schematic view of a transporting apparatus operating according to the present invention with transporting members moving on a circular path.

The apparatus represented in FIG. 6 operates analogously to the apparatus according to FIG. 2 by a process in which products 64, 65 delivered by means of a feed conveyor 63 are divided into two different product streams by means of two piece-goods transporting apparatuses 66. The optionally different products 64, 65 are, analogously to FIG. 2, delivered alternately by the feed conveyor. For reasons of clarity, only one of the piece-goods transporting apparatuses 66 interacting with the feed conveyor 63 is represented in FIG. 6.

The piece-goods transporting apparatus 66 exhibits a circular guide path 67 along which a number of grippers 68 are driven in rotation.

Provided in the upper region of the circular path 67 is the receiving position 69 at which products 64, 65 are transferred from the feed conveyor 63 to the piece-goods transporting apparatus 66. Provided in the lower region of the circular path 67 is the discharge position 70 at which products are transferred from the piece-goods transporting apparatus 66 to a removal conveyor 71, which is designed, in FIG. 6, as a processing section which is intended for collecting printed products and in which printed products 64, 65 are deposited in a straddling manner on saddle-like rests 72.

Provided in each case in the region of the receiving position 69 and in the region of the discharge position 70 is a guide element 75 and 76, respectively, which is driven around two rollers 73 and 74, respectively, and is suitable for conveying the grippers 68 rotating on the circular path 67 at a defined distance from one another in the region of the guide elements 75, 76. For this purpose, the rotating guide elements 75, 76 exhibit receiving means which are arranged in an equidistant manner and are intended for the grippers 68.

Arranged at the beginning of the guide elements 75, 76 in a conveying direction is one blocking element 77, 78 which, in its actuating position, is suitable for preventing a gripper 68 from being conveyed into the region of the guide elements 75, 76.

The blocking element 77 arranged in the region of the receiving position 69 is forced in the direction of the depicted double arrow by an intelligent control unit, while the blocking element 78 arranged in the region of the discharge position 70 is actuated only periodically in a regular cycle, in the direction of the double arrow depicted there, and thus ensures that, during each cycle, one gripper 68 provided with a product 65 is received by a receiving means of the guide element 76 and conveyed away.

The blocking element 77 is activated, analogously to the blocking element 29 according to FIG. 2, such that only every second receiving means of the guide element 75 conveys a gripper past the receiving position 69, with the result that only every second product is received by the piece-goods transporting apparatus 66 at the receiving position 69. In order to make this possible, it has to be ensured that the distance between adjacent receiving means of the guide element 75 corresponds to the distance between the individual products 64, 65 in the feed conveyor 63.

In the event of a gap occurring in the product stream delivered by the feed conveyor 63, when, for example, a product 65 is missing, this is detected by means of a detection unit (not shown) and the blocking element 77 can be actuated in such a manner that receiving means of the guide element 75 pass the blocking element 77 without a gripper 68 being carried along. The next gripper 68 only passes the blocking element 77 again when the next product 65 is provided.

Since the products 65 conveyed by the piece-goods transporting apparatus 66 between the receiving position 69 and the discharge position 70 are stored temporarily and the grippers 68 are guided on the circular path 67 such that they can be displaced relative to one another, a gap in the product stream delivered by the feed conveyor 63 can be closed in the described manner.

As long as a sufficient number of products 65 are stored temporarily in the region of the buffer section 79 and the blocking element 78 is actuated in such a manner that each receiving means of the guide element 76 conveys a gripper 68 provided with a product 65, it is ensured that each saddle-like rest running past the discharge position 70 is provided with a product 65.

Arranged in the rear region of the buffer section 79, as seen in the conveying direction, is a guide surface 80 which ensures that the bloom of the products 65, which are each retained in the respective gripper 68 by means of their fold, are guided in a precise manner in the direction of an opening element 81, which ensures that the products 65 can be opened in the region of the discharge position 70 and thus can be deposited without difficulty onto the saddle-like rests 72.

FIG. 7 shows two operating processes of a piece-goods transporting apparatus 82 which operates according to the invention and receives products 83 from a drum system 84, wherein a plurality of individual products are collected on saddle-like rests 85 and are thus brought together to form finished products 83. In the case of the apparatus represented in FIG. 7, the drum system 84 assumes the function of the feed conveyor.

The piece-goods transporting apparatus 82 exhibits circulating grippers 86 which are guided, in the region of the receiving position 87, in guides 88 of a guide element 89 which, in turn, circulates around two rollers 90. Provided upstream of the first roller 90, as seen in the transporting direction of the empty grippers 86, is a blocking element 91 which is suitable, in its actuating position, for arresting empty grippers 86 conveyed in the direction of the guide element 89 and thus for preventing the gripper 86 located respectively upstream of the blocking element 91 from being carried along by a guide 88. For this purpose, the grippers 86 have to be guided, directly upstream of the blocking element 91, so that they can be moved relative to one another, in such a manner that their mutual spacing is variable in order thus to permit an accumulation of grippers 86 upstream of the blocking element 91.

Figure 7A:
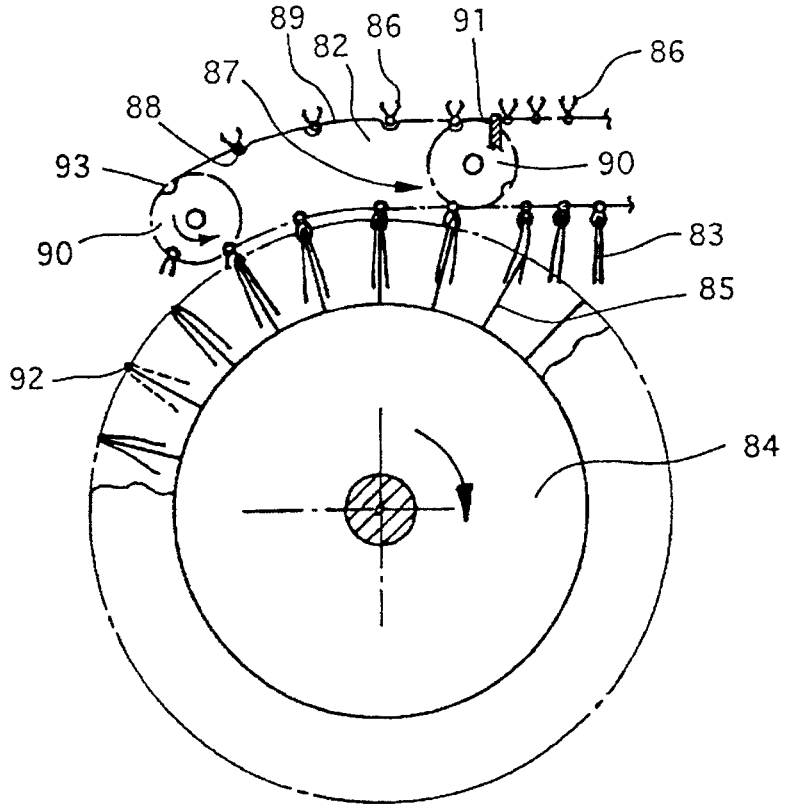
FIGS. 7*a, b* are schematic views depicting different operating phases of a further embodiment of a transporting apparatus operating according to the present invention shown in the region of the receiving position.

In the operating position represented in FIG. 7*a*, it has been detected that a gap 92 or a defective product is transported in the direction of the receiving position 87 by the drum system 84 acting as a feed conveyor.

Accordingly, a gripper 86 has been arrested by the blocking element 91 until such time as the guide 93 of the guide element 89 has passed the region of the blocking element 91 without carrying along a gripper 86. This accordingly creates, in the grippers 86 carried along by the guides 88 of the guide element 89, a gap which is formed by the receiving means 93 and of which the movement is synchronized with the gap 92 of the drum system 84, with the result that, at the point in time at which the gap 92 reaches the receiving position 87, there is no gripper 86 located over the saddle-like rest 85 belonging to the gap 92. This thus ensures that no gripper 86 leaves the region of the receiving position 87 without a defect-free product 83.

Figure 7B:
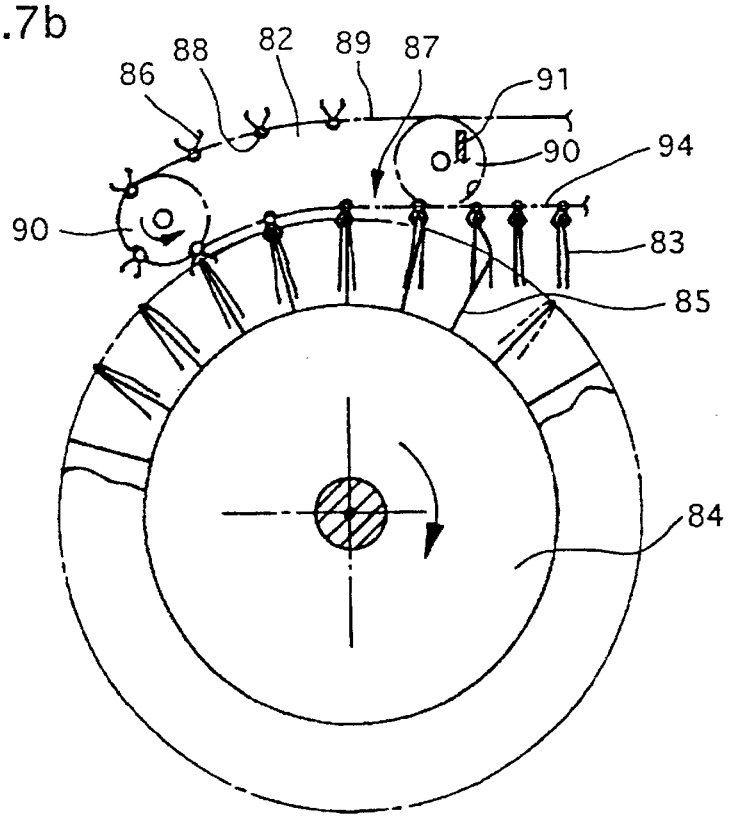

Since the grippers 86 which have been provided with products are arranged, in the region downstream of the guide element 89, once again such that they can be displaced relative to one another and since a buffer section 94 functioning as temporary storage is provided in this region, the above-described mode of operation of an apparatus according to FIG. 7 provides, in accordance with the representation in FIG. 7*b*, a continuous product stream running away from the drum system 84, of which the continuity is ensured even if the individual saddle-like rests 85 of the drum system 84 are not occupied. Gaps formed by unoccupied saddle-like rests 85 and "artificial gaps" formed by defective products are closed by the mode of operation according to the invention of the piece-goods transporting apparatus 82. After running through the receiving position 87, defective products are ejected from the drum system 84.

FIG. 8 shows two operating states of a piece-goods transporting apparatus 97 which operates according to the invention and is arranged between a feed conveyor 95 and a removal conveyor 96.

The feed conveyor 95 exhibits grippers 98 which are driven in circulation and feed products 99 to the piece-goods transporting apparatus 97 in the region of a receiving position 100, at regular intervals from one another.

The removal conveyor 96 exhibits V-shaped receiving means 101 which are conveyed in the arrow direction and which are each spaced apart at the same distance from one another and into which the products 99 can be introduced by the piece-goods transporting apparatus 97 in the region of the discharge position 102.

The piece-goods transporting apparatus 97 comprises a number of spokes 104 which are driven in rotation around a hub 103 and at whose end, remote from the hub, one gripper 105 is fitted in a pivotable manner. In this arrangement, the spokes 104 are mounted around the hub 103 in such a manner that they can change their angular position with respect to one another at least in the regions located respectively between the receiving position and the discharge position. This makes it possible in each case for a number of spokes 104 or grippers 105 which is adapted to the requirement at any one time to be stored temporarily in the regions between the receiving position and the discharge position.

In the region of the receiving position 100 and of the discharge position 102, the spokes 104, with the grippers 105 located therein, are each guided by a guide element 106 and 107, respectively, such that, for the case where all the receiving means 108 of the guide elements 106, 107 each carry along a gripper 105, the spokes are each spaced apart at the same distance from one another.

Provided upstream of the guide element 106 assigned to the receiving position 100 is a blocking element 109 Which, in its actuating position, ensures that the spoke 104 located directly upstream of the blocking element 109, along with the gripper 105 located on said spoke, is prevented from being carried along by the receiving means 108 of the guide element 106. In this case, there is briefly formed upstream of the blocking element 109 an accumulation of spokes 104, in which the angle formed between two adjacent spokes 104 is smaller than that in the region of spokes 104 guided by the guide element 106 or 107.

Analogous to the blocking element 109, a blocking element 110 may likewise be provided upstream of the guide element 107, in the region of the discharge position 102, which blocking element 110 permits, periodically in cycles, grippers 105 with products 99 to be fed to the guide element 107.

The blocking element 109 is connected to a control unit (not shown) which acts on the blocking element in dependence on product gaps arising in the feed conveyor 95.

Figure 8A:
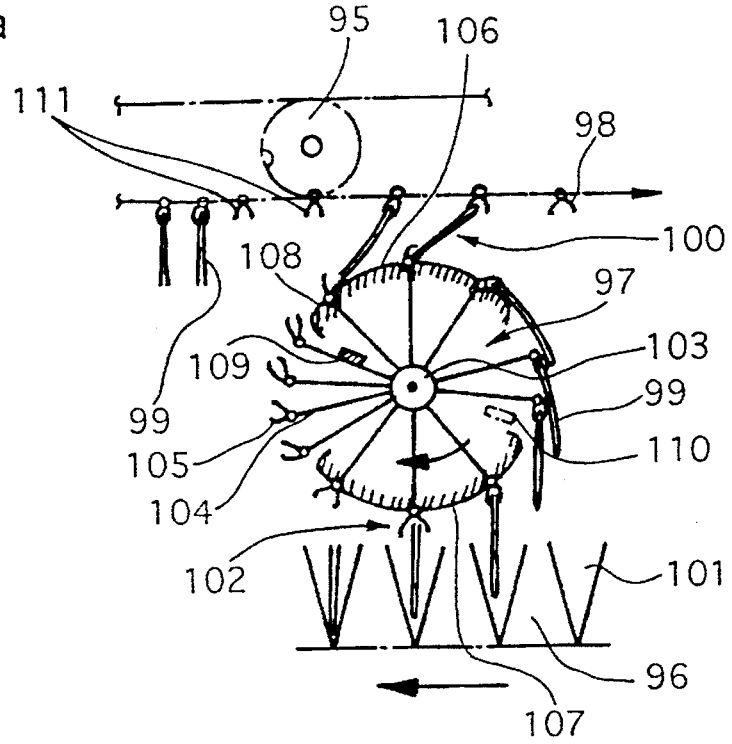
FIGS. 8*a, b* are schematic views showing different operating phases of a further embodiment of a transporting apparatus operating according to the present invention.

Shown in FIG. 8*a* are two successive grippers 111 of the feed conveyor 95, which are conveyed in the direction of the receiving position 100 and do not bear a product 99. This double gap is detected by means of a suitable detection unit, resulting in an actuation of the blocking element 109 according to FIG. 8*b*, which actuation initiates the arresting of spokes 104 upstream of the guide element 106. In this arrangement, the spokes 104 are arrested precisely until two receiving means 108 have passed the region of the blocking element 109 without receiving a spoke 104 with gripper 105.

Figure 8B:
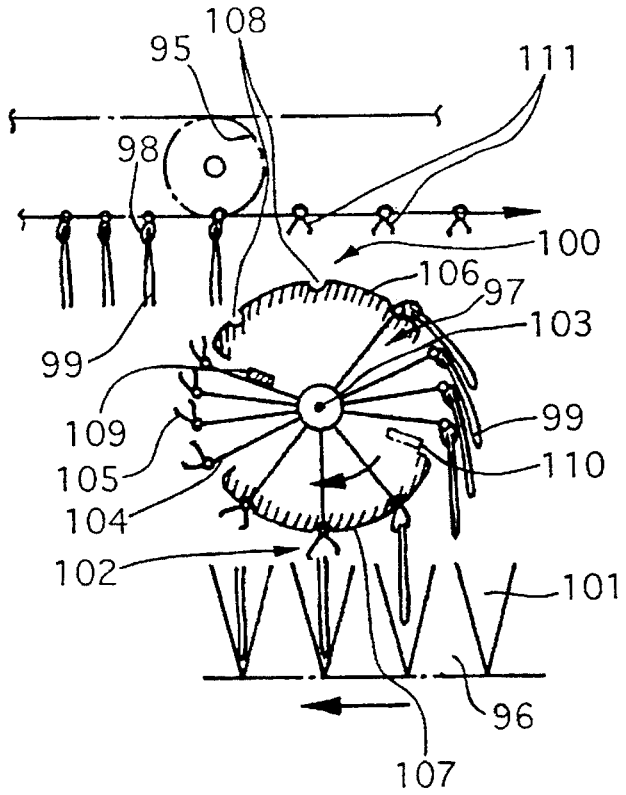

The two empty receiving means 108 according to FIG. 8*b* run past synchronously beneath the two empty grippers 111 of the feed conveyor 95. This thus reliably precludes the situation where a gripper 105 leaves the guide element 106 arranged in the receiving region 100 without a product 99 being received.

After the two empty grippers 111 of the feed conveyor 95 have been conveyed past the receiving position 100, then, by corresponding actuation of the blocking element 109, the next gripper 105 passes, by engagement into a receiving means 108 of the guide element 106, beneath the next product 99 conveyed in by the feed conveyor 95, receives said next product 99 and conveys it in the direction of the discharge position 102. Due to the variable angular position of the spokes 107 in the region located downstream of the guide element 106 in the transporting direction, gaps which have occurred according to FIG. 8*b* can be closed without difficulty since, after the passage of the gap, the next gripper 105 with received product 109 swings downwards after it has run through the guide element 106; spoke 104 which is assigned to said gripper 105 being set in its minimal angular position with respect to the preceding spoke 104.

A correspondingly timed actuation of the blocking element 110 can then ensure a continuous and nninterrupted discharge of products 99 to the removal conveyor 96. Intelligent control of the blocking element 110 assigned to the discharge position 102 is not necessary for this purpose. Activation periodically in cycles is sufficient.

In the examples shown, the blocking element 30, 78, 110 arranged upstream of the discharge position serves in each case for directing the grippers of the piece-goods transporting apparatus 21, 22, 66, 97 in a cyclic manner to the drive for the grippers. The blocking elements can be dispensed with if the drive is designed such that it carries along a gripper in each cycle and then displaces it into the discharge position.

The construction and mode of function of the piece-goods transporting apparatuses shown in FIGS. 1 to 7 is described in detail in the earlier CH Patent Application No. 02 040/93-6 and corresponding U.S. Pat. No. 5,503,264. That disclosure is incorporated herewith by reference. The discharge of the products from the piece-goods transporting apparatus takes place, however, in a cyclic and uncontrolled manner. That embodiment of the piece-goods transporting apparatus which is shown in FIGS. 8*a* and 8*b* is based on the same principle.

That which is claimed is:

1. A process for operating a piece-goods transporting apparatus for printed products comprising the steps of receiving products individually one after the other at a receiving position from a feed conveyor, said products being transported away from the receiving position by transporting members circulating in a continuous guide and so as to be conveyed through a buffer section to a discharge position, the transporting members being retained at the receiving position until a product has been received, thereby ensuring that each transporting member leaves the receiving position with a received product, wherein the transporting members pass through the discharge position periodically in cycles and discharge a product in each cycle, and wherein only every nth product is received from the feed conveyor at the receiving position, with n being greater than 1.

2. A process according to claim 1, wherein the products are received at a plurality of spaced-apart receiving positions from the feed conveyor, and wherein each receiving position is assigned a separate buffer section and a separate discharge position.

3. A process according to claim 1 wherein the products discharged at the discharge position are received and transported away therefrom by a collecting apparatus, and comprising the further step of bringing together one or more additional products with each of the discharged products to form part-products or final products by means of collecting, collating or inserting.

4. A process according to claim 1 wherein the feed conveyor comprises a clamp-type transporter.

5. A process according to claim 1 further comprising the step of setting the number of products which are not received at the receiving position between each pair of received products.

6. A process according to claim 1 wherein during a discharge cycle an average of n products are fed to the receiving position and one of these n products is received.

7. A process according to claim 1 wherein the non-received products are conveyed by the feed conveyor to downstream receiving positions and are received therein.

8. A process according to claim 1 wherein the products discharged at the discharge position are transported away by a cyclic removal conveyor comprising a clamp-type transporter.

9. A process according to claim 1 wherein in the buffer section the transporting members are spaced apart a variable distance from one another.

10. A process according to claim 1 wherein the products are provided in a continuous stream by the feed conveyor and any gaps or discontinuities which arise are detected and wherein the transporting member at the receiving position is arrested in response to such detection.

11. A process according to claim 1 wherein the products discharged at the discharge position are received and transported away therefrom by a collecting apparatus, and wherein the speed of the collecting apparatus is synchronized with the cycles of the transporting members passing through the discharge position.

12. A process for operating a piece-goods transporting apparatus for printed products comprising the steps of receiving products individually one after the other at a receiving position from a feed conveyor, said products being transported away from the receiving position by transporting members circulating in a continuous guide and so as to be conveyed through a buffer section to a discharge position, the transporting members being retained at the receiving position until a product has been received, thereby ensuring that each transporting member leaves the receiving position with a received product, wherein the transporting members pass through the discharge position periodically in cycles and discharge a product in each cycle, and wherein non-received products are conveyed by the feed conveyor to one or more downstream receiving positions and are received therein.

13. A process according to claim 12 wherein at each downstream receiving position, products are transported away therefrom by transporting members which are circulated through a separate buffer section and to a separate discharge position.

14. A process according to claim 13 wherein the feed conveyor comprises a clamp-type transporter.

15. A process according to claim 12 wherein the products discharged at the discharge position are received and transported away therefrom by a collecting apparatus, and wherein the speed of the collecting apparatus is synchronized with the cycles of the transporting members passing through the discharge position.

16. A process according to claim 15 wherein only every nth product is received from the feed conveyor at the receiving position, with n being greater than 1.

17. A process according to claim 15 wherein in the buffer section, the distance between the transporting members is variable so as to permit storage of a variable number of transporting members therein.

* * * * *